US005338035A

United States Patent [19]

Lyford

[11] Patent Number: 5,338,035

[45] Date of Patent: Aug. 16, 1994

[54] PRACTICE GOLF CLUB

[76] Inventor: Keith S. Lyford, 9097 E. Meadowhills, Scottsdale, Ariz. 85260

[21] Appl. No.: 800,451

[22] Filed: Nov. 26, 1991

[51] Int. Cl.[5] ..... A63B 69/36

[52] U.S. Cl. ..... 273/186.2; 273/193 B

[58] Field of Search ..... 273/80 B, 193 B, 186 A, 273/183 D, 186.2, 186.3, 187.4, 193 B

[56] References Cited

U.S. PATENT DOCUMENTS

| | | | |
|---|---|---|---|
| 1,529,305 | 3/1925 | Gatke | 273/193 |
| 1,662,712 | 3/1928 | Mensing | 273/80 B |
| 2,158,211 | 5/1939 | Aitken | 273/186 |
| 2,497,237 | 2/1950 | Reineking | 273/193 |
| 3,033,575 | 5/1962 | Hause | 273/193 |
| 3,170,690 | 2/1965 | Goranson | 273/193 |
| 3,606,340 | 9/1971 | Tiller | 273/193 |
| 4,854,585 | 8/1989 | Koch et al. | 273/193 B |
| 4,856,782 | 8/1989 | Cannan | 273/80 B |
| 5,205,561 | 4/1993 | Lux | 273/193 B |

*Primary Examiner*—George J. Marlo

*Attorney, Agent, or Firm*—Fishman, Dionne & Cantor

[57] ABSTRACT

A practice golf club is presented. In accordance with the present invention, the practice golf club comprises upper and lower shafts connected by a one-way hinge. The one-way hinge is located near the lower end of the club. The upper shaft has a grip at its upper end and the lower shaft has a head at its lower end. The hinge is designed to break or pivot rearwardly at an angle relative to the reference plane of the club face. The reference plane of the club face is defined as the plane in which the club face of an iron having a 0° loft lies. This angle is from 0° (i.e., in the reference plane of the club face) to about 45°. During use of this practice club, the hinge will pivot mirroring the correct wrist position of the golfer during a correct golf stroke. Therefore, during the backswing of a correct swing, the hinge will break or pivot and remain so pivoted through most of the downswing as will the golfer's wrist. The upper and lower shafts will come back into alignment as the golfer's wrist straightens out just prior to the bottom of the downswing. Accordingly, unless the golfer's wrist are properly positioned during the backswing, the hinge will not pivot.

7 Claims, 4 Drawing Sheets

PRACTICE GOLF CLUB

BACKGROUND OF THE INVENTION

This invention relates to practice or training golf clubs. More particularly, this invention relates to a practice golf club which indicates a proper swing by mirroring the wrist position of the golfer throughout the golf stroke.

Practice or training golf clubs having hinged shafts are known. These practice clubs generally comprise a shaft having a grip at one end and a golf club head attached to the other end. The shaft further has upper and lower shaft portions connected by a hinge. Examples of such prior art practice golf clubs include U.S. Pat. No. 3,033,575 to Hause, U.S. Pat. No. 4,854,585 to Koch et al and U.S. Pat. No. 2,497,237 to Reineking.

The practice golf club of U.S. Pat. No. 3,033,575 comprises a golf club having upper and lower shafts connected by a one-way hinge. The one-way hinge is located near the lower end of the club. The upper shaft has a grip at its upper end and the lower shaft has a head at its lower end. This hinge orientated so as to allow the hinge to break or pivot in a rearward direction perpendicular to the head. The practice club of U.S. Pat. No. 3,033,575 is designed to break or pivot at the hinge when the golf club is improperly swung during the backswing. This is due to the orientation of the hinge relative to the face of the club head. This hinge is positioned for breaking along a plane at about a 90° angle relative to the reference plane of the club face. The reference plane of the club face is defined as the plane in which the club face of an iron having a 0° loft lies. This club may be used to hit a golf ball when properly swung. An improper golf swing includes a jerking motion as opposed to a steady smooth swing or an improper angle of the club face during the swing (e.g., an open club face, known as a "slice" or a closed club face, known as a "hook").

The practice club of U.S. Pat. No. 4,854,585 comprises a golf club having upper and lower shafts connected by a two-way hinge. The two-way hinge is located near the lower end of the club. The upper shaft has a grip at its upper end and the lower shaft has a head at its lower end. The hinge is orientated pivot at about a 90° angle with the reference plane of the club face. The practice golf club of U.S. Pat. No. 4,854,5.85 is designed to break or pivot when the golf club is improperly swung. This club may be used to hit a golf ball when properly swung.

The practice putter of U.S. Pat. No. 2,497,237 also comprises a golf club having upper and lower shafts connected a one-way hinge. The one-way hinge is located near the upper end of the club. The upper shaft has a grip at its upper end and the lower shaft has a head at its lower end. The hinge orientated to pivot at about a 90° angle with the reference plane of the club face. The practice golf club of U.S. Pat. No. 2,497,237 is designed to break or pivot when the golf club is improperly swung (i.e., a jerking motion as opposed to a steady smooth swing). This club may be used to hit a golf ball when properly swung.

These prior art practice golf clubs attempt to correct for improper angles of the club face during a swing before breaking at the hinge. However, need exists for a practice golf club which will better indicate a proper swing throughout the golf stroke (i.e., backswing, downswing and follow through swing).

SUMMARY OF THE INVENTION

The above-discussed and other drawbacks and deficiencies of the prior art are overcome or alleviated by the practice golf club of the present invention. In accordance with the present invention, the practice golf club comprises upper and lower shafts connected by a one-way hinge. The one-way hinge is located near the lower end of the club. The upper shaft has a grip at its upper end and the lower shaft has a head at its lower end. The hinge is designed to break or pivot rearwardly at an angle relative to the reference plane of the club face. This angle is from 0° (i.e., in the reference plane of the club face) to about 45°. During use of this practice club the hinge will pivot mirroring the correct wrist position of the golfer during a correct golf stroke. Therefore, during the backswing of a correct swing, the hinge will break or pivot and remain so pivoted through most of the downswing as will the golfer's wrist. The upper and lower shafts will come back into alignment as the golfer's wrist straightens out just prior to the bottom of the downswing. Accordingly, unless the golfer's wrist are properly positioned during the backswing, the hinge will not pivot.

Thus, unlike the prior art practice golf clubs wherein the hinge pivots during an incorrect golf swing, the hinge in the present invention only pivots during a correct golf swing. The orientation of the hinge relative to the reference plane of the club face is an important feature of the present invention as it prevents the hinge from pivoting during incorrect golf swings. Further, the prior art practice golf clubs focused on the angle of the club face relative to the ball while the present invention focuses on the proper positioning of the golfer's wrist throughout the golf swing.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES:

FIGS. 14A–D are sequential views showing the use of the hinged practice golf club of FIG. 4 for a proper swing, wherein FIG. 14A is the initial position, FIG. 14B is during the backswing, FIG. 14C is at the bottom of the downswing and FIG. 14D is at the position of normal impact with a golf ball.

DESCRIPTION OF THE PREFERRED EMBODIMENT

Figure 3:
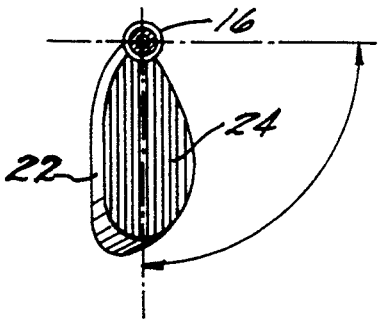
FIG. 3 (PRIOR ART)
FIG. 3 is a view taken along the line 3—3 of FIG. 1.
Figure 1:
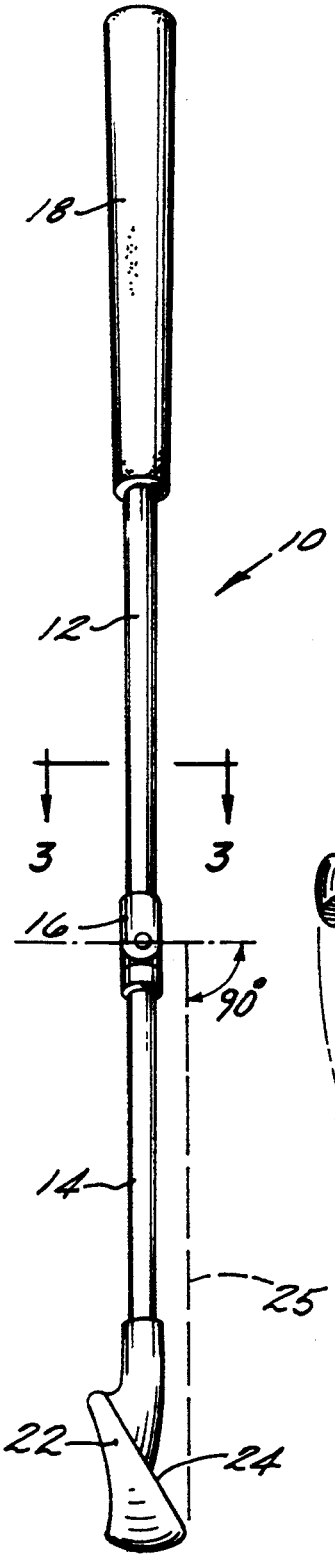
FIG. 1 (PRIOR ART)
FIG. 1 is a front elevational view of a hinged practice golf club with the hinge in alignment, in accordance with the prior art.
Figure 2:
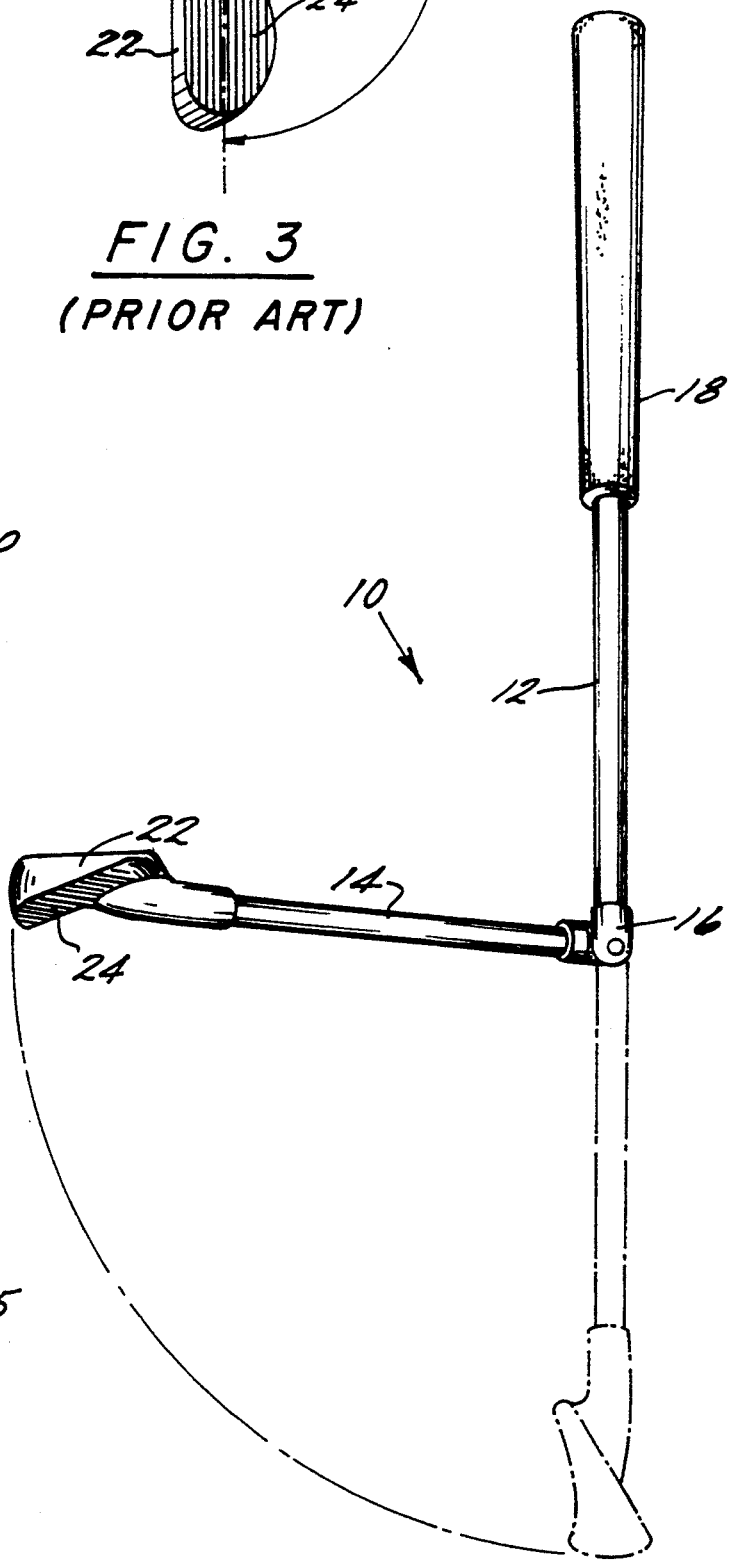
FIG. 2 (PRIOR ART)
FIG. 2 is a front elevational view of the hinged practice golf club of FIG. 1 with the hinge pivoted.

Referring to prior art FIG. 1, the practice golf club of U.S. Pat. No. 3,033,575 is shown generally at 10. Club 10 comprises an upper shaft 12 and a lower shaft 14 connected by a one-way hinge 16. A grip 18 is secured about the upper end of shaft 12. A head 22 is afixed to the lower end of shaft 14. Head 22 is illustrated as an conventional iron. Hinge 16 is one-way hinge orientated to allow shaft 14 to pivot rearwardly as is clearly shown in prior art FIG. 2. Referring to prior art FIGS. 2 and 3, when hinge 16 is pivoted, a club face 24 having a reference plane 25 is; at about a 90° angle with shaft 12.

During a proper golf swing with club 10, shafts 12 and 14 will remain in alignment (i.e., hinge 16 will not pivot). This allows club 10 to be used for hitting a golf ball when properly swung. However, during the golf stroke, a wide range of angles for the club face 24 relative to the optimal angle are allowed before hinge 16 pivots.

Figure 4:
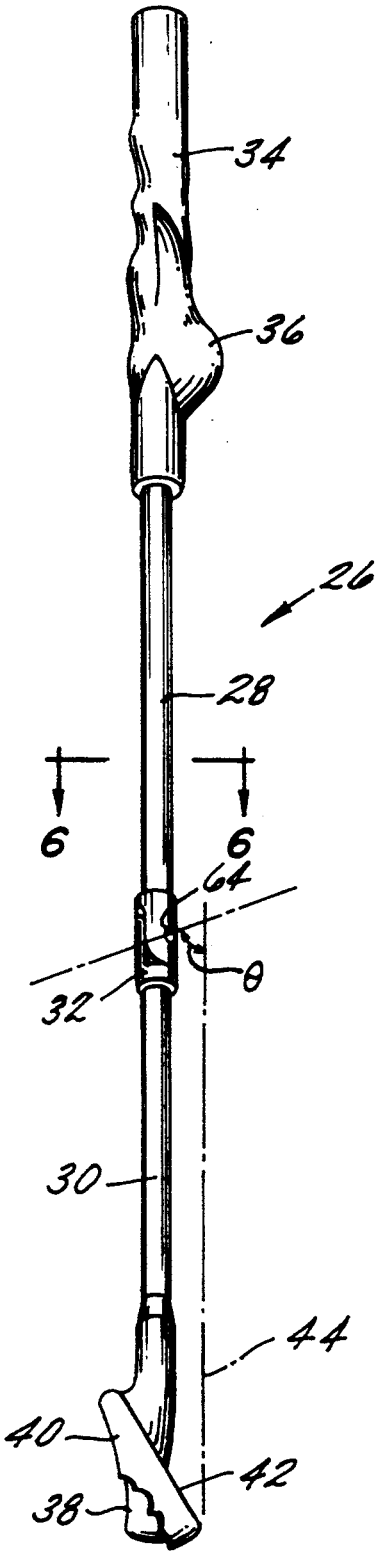
FIG. 4 is a front elevational view of a hinged practice golf club with the hinge in alignment, in accordance with the present invention.

Referring now to FIG. 4, a practice golf club is shown generally at 26. Club 26 comprises an upper shaft 28 and a lower shaft 30 connected by a one-way hinge 32. It is preferred that hinge 32 be comprised of stainless steel or other suitable material. Shaft 28 comprises about three-fourths the length of club 26 and shaft 30 comprises about one-fourth the length of club 26. Shafts 28 and 30 are preferably a tubular metal, commonly employed for golf club shafts. It will be appreciated, however, that any suitable material may be used for shafts 28 and 30 (e.g., wood, fiberglass). A grip 34 is secured about the upper end of shaft 28 by well known methods. It is preferred that grip 34 comprise a molded training grip which has raised features 36 to assure proper hand positioning when swinging club 26. However, standard golf club grips may be employed for grip 34. A head 38 is afixed to the lower end of shaft 30. Head 38 is illustrated as an conventional iron with a protective coating 40 covering head 38. Coating 40 preferably comprises a durable rubber or plastic material. It will also be appreciated that head 38 may be a conventional wood or any other type of golf club head.

Figure 6:
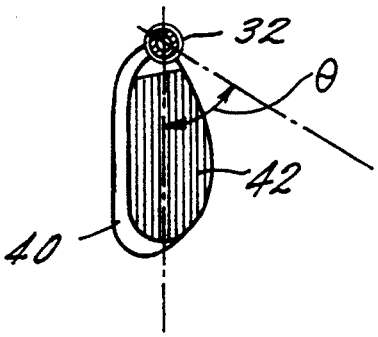
FIG. 6 is a view taken along the line 6—6 of FIG. 4.
Figure 5:
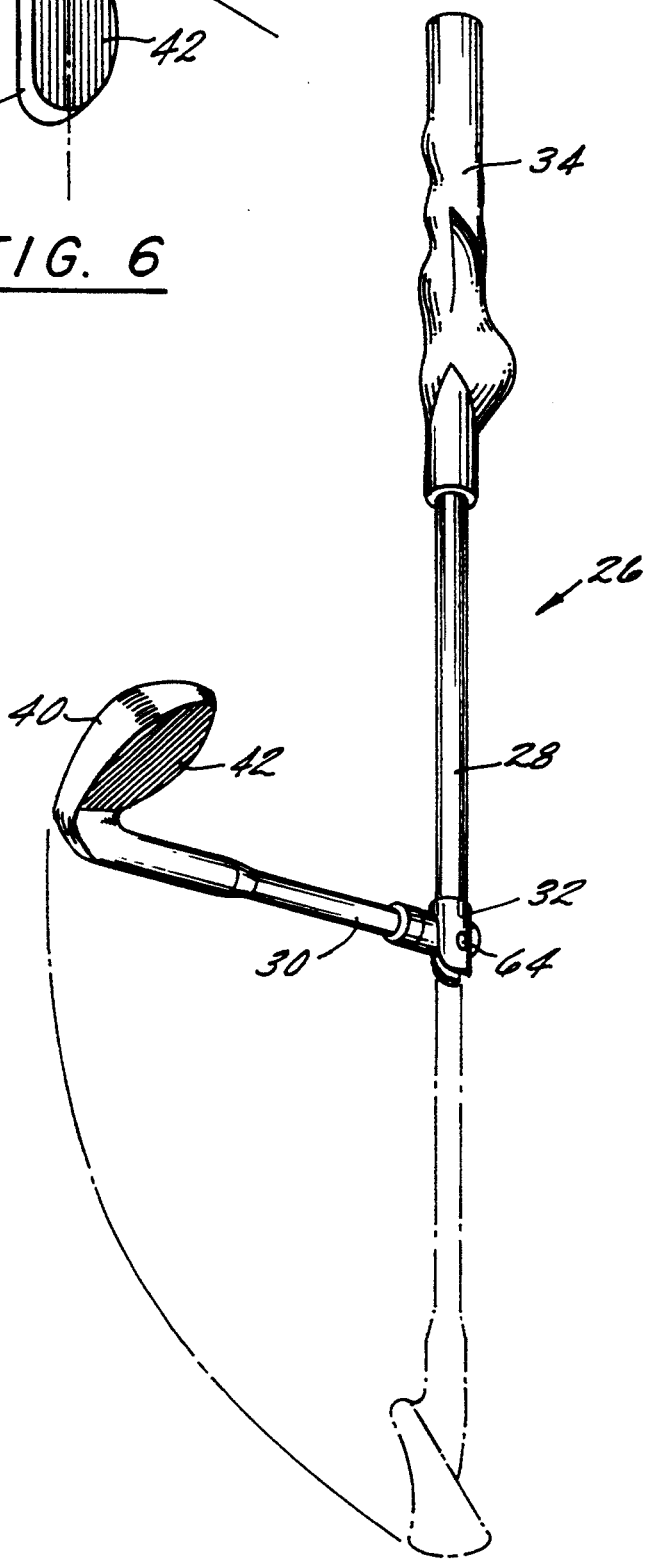
FIG. 5 is a front elevational view of the hinged practice golf club of FIG. 4 with the hinge pivoted.

Hinge 32 comprises a one-way hinge orientated to allow shaft 30 to pivot rearwardly and upwardly as is clearly shown in FIG. 5. Referring to FIGS. 5 and 6, when hinge 32 is pivoted, a club face 42 having a reference plane 44 is at an angle ($\theta$) with respect to shaft 28. This angle ($\theta$) is from 0° (i.e., shaft 30 pivots relative to shaft 28 in the reference plane 44) to about 45°. This angular orientation of hinge 32 is unlike the prior art (FIGS. 1, 2 and 3) wherein reference plane 25 for club face 24 is at about a 90° angle with respect to upper shaft 12 when pivoted.

Figure 7:
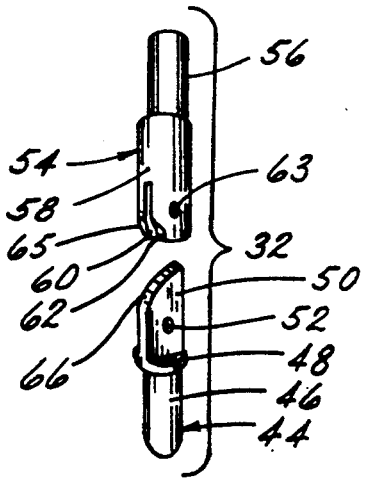
FIG. 7 is an exploded view of the two hinge members shown in FIGS. 4 and 5.
Figure 8:
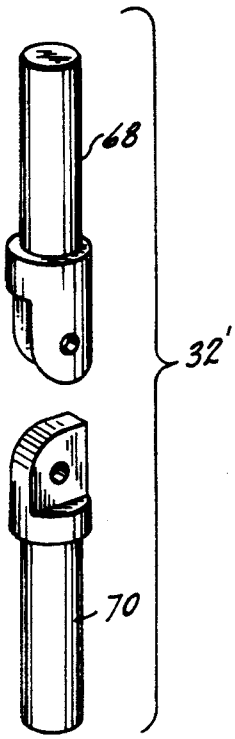
FIG. 8 is an exploded view of an alternate embodiment of the two hinge members shown in FIGS. 4 and 5.

Referring now to FIG. 7, hinge 32 is shown comprising a lower hinge member 44 including a hollow, depending symmetrical portion 46, a collar 48 at one end of portion 46 and a tongue 50 at the opposite end of collar 48. Tongue 50 is provided with an aperture 52 extending laterally therethrough. An upper hinge member 54 includes a hollow cylindrical portion 56 extending upwardly from a body portion 58 having a groove 60 formed therein and adapted to receive tongue 50 of lower hinge member 44. Groove 60 divides or bifurcates the lower end of hinge member 54 into a pair of aperture fingers 62. An aperture 63 extends through fingers 62. A pin 64 (FIGS. 4 and 5) extends through apertures 52 and 63 for connecting the upper and lower hinge members 54, 44. The bottom or end of groove 60 is defined by a rounded sloping shoulder 65 which is engaged by a conformably sloping shoulder 66 formed on the end of tongue 50. It will be appreciated that these shoulders 65, 66 engage one another on a plane which has the angle 8 between the plane and the reference plane 44. Portion 56 of upper hinge member 54 is tightly fitted within upper shaft 28 and is tightly held therein by well known means (e.g., welding or an adhesive). Portion 46 of lower hinge member 44 is fitted within lower shaft 30 and is held therein by similar means.

Figure 13:
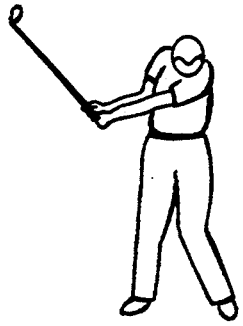
FIG. 13 is a view showing the use of the hinged practice golf club of FIG. 4 for an improper swing.

When hinge 32 is pivoted, shoulder 66 on lower hinge member 44 will move away from shoulder 65 on upper hinge member 54. This is a generally rearward direction relative to the face of the club at an angular movement of $\theta$ in a clockwise direction as viewed in FIG. 5. This movement is limited by abutment of shoulder 66 against shoulder 65 when shafts 28, 30 are disposed in alignment. By virtue of the angle $\theta$ of hinge 32 relative to the reference plane 44 of club 26, hinge 32 will only break or pivot when club 26 is properly swung as illustrated in sequential FIGS. 14A–14D. However, if the club is improperly swung, (i.e., the golfer's wrist are not properly hinged or are released early in the swing) hinge 32 will not pivot as is illustrated in FIG. 13 or will snap back into alignment in the case of an early release. This is unlike the prior art, wherein hinge 16 pivots when club 10 is improperly swung and shafts 12 and 14 remain in alignment when club 10 is properly swung.

Figure 11:
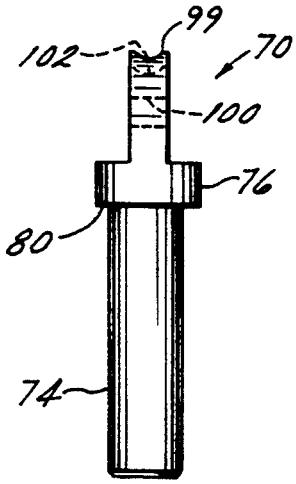
FIG. 11 is front view of the lower hinge member of the hinge of FIG. 8.
Figure 12:
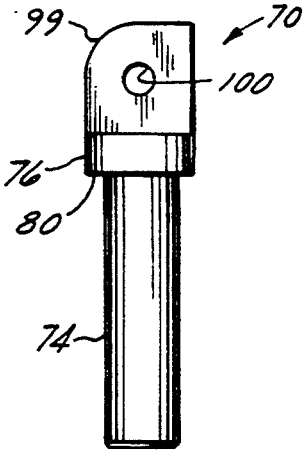
FIG. 12 is a side elevational view of the lower hinge member of the hinge of FIG. 8.

Referring to FIGS. 8–12, an alternative embodiment of hinge 32 is denoted by a 32' and comprises an upper member 68 (FIGS. 9 and 10) and a lower member 70 (FIGS. 11 and 12). Member 68 is secured at a first end 72 to shaft 28 by known means, as set forth hereinbefore. Similarly, member 70 is secured at a first end 74 to shaft 30 by known means, as set forth hereinbefore.

Ends 72, 74 of members 68, 70, respectively, have a generally cylindrical configuration that conforms to the tubular construction of shafts 28 and 30. Respective ends 76, 78 of the members 68, 70 have an enlarged diameter relative to the ends 72, 74 to define radial shoulders, 80, 82. The radial shoulders 80, 82 abuttingly engage terminal ends of the shafts 30, 28 and positively locate hinge 32' thereto.

Figure 9:
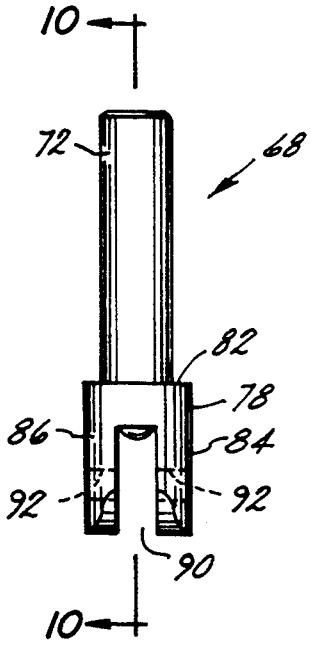
FIG. 9 is a front view of the upper hinge member of the hinge of FIG. 8.
Figure 10:
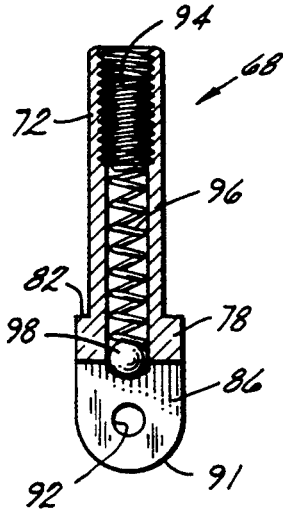
FIG. 10 is a partial cross-sectional side elevational view taken along the line 10—10 of FIG. 9.

End 78 of member 68 includes first and second yoke portions 84, 86 (FIG. 9). Yoke portions 84 and 86 extend axially and generally parallel to the longitudinal dimension of shaft 28. An interconnecting portion or web 88 joins one end of each yoke portion 84, 86 to define a generally U-shaped cavity 90. U-shaped cavity 90 facilitates one-way movement of hinge 32 as will become apparent below.

Each yoke portion 84, 86 includes a smooth, arcuate surface 91 along the terminal edge of end 78. Moreover, an aperture 92 extends through each yoke portion 84, 86 in a direction generally perpendicular to the longitudinal extent of shaft 28. Apertures 92 in respective yoke portions 84, 86 are aligned to receive a pivot pin (not shown) that secures members 68 and 70 of hinge 32' together. The pivot pin locks members 68 and 70 against axial movement but permits relative rotation there around (i.e., pivoting or breaking of hinge 32').

End 72 of member 68 is of hollow configuration adapted to accommodate an adjustable tensioning means D for hinge 32'. End 72 is integrally threaded to receive an adjusting screw 94. An outer end of screw 94 may be slotted or otherwise configured to receive an adjusting tool such as a screwdriver (not shown). An inner end of screw 94 abuttingly engages one end of a biasing means such as a helical spring 96. The other end of spring 96 engages a generally spherical member or ball 98 that extends partially into cavity 90. Selective axial advancement and retraction of the screw adjusts the biasing force on ball 98 to, in turn, adjust the force necessary to articulate (i.e., pivot or break) hinge 32 around the pivot pin.

Preferably, spring 96 is of chromium silicon wire manufacture, although, alternative materials may be used. The forces and resultant wear and tear on spring 96 necessitate a durable material.

Member 70 includes a sloping surface 99 that only permits one-way articulation of member 70 relative to member 68. It will be appreciated that these surfaces 91, 99 engage one another on a plane which has the angle 8 between the plane and the reference plane 44. A generally centrally located aperture 100 receives the pivot pin therethrough to secure members 68 and 70 of hinge 32' together as described above. A spherically-shaped recess 102 is defined at end 76 of member 70 to matingly receive the external surface of ball 98. Recess 102 assures sufficient contact with member 68 to maintain axial alignment of hinge 32' until a predetermined force generated by a correct swing overcomes the biasing force of spring 96 and permits selective pivoting of hinge 32'.

When hinge 32' is pivoted, surface 99 on lower hinge member 70 will move away from surface 91 on upper hinge member 68. This is a generally rearward direction relative to the face of the club at an angular movement of 8 in a clockwise direction as viewed in FIG. 5. This movement is limited by abutment of surface 99 against surface 91 when shafts 28, 30 are disposed in alignment. By virtue of the angle 8 of hinge 32' relative to the reference plane 44 of club 26, hinge 32' will only break or pivot when club 26 is properly swung as illustrated in sequential FIGS. 14A–14D. However, if the club is improperly swung, (i.e., the golfer's wrist are not properly hinged or are released early in the swing) hinge 32' will not pivot as is illustrated in FIG. 13 or will snap back into alignment in the case of an early release.

Figure 14A:
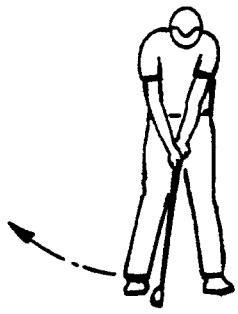
Figure 14B:
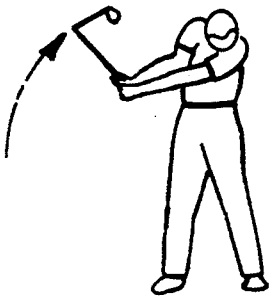
Figure 14C:
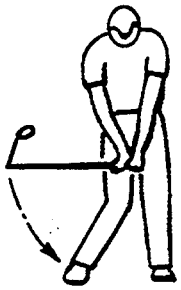
Figure 14D:
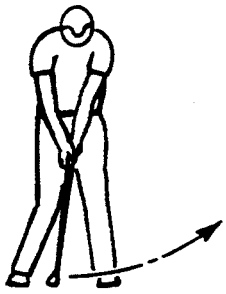

Referring now to FIGS. 14A–14D, a proper golf stroke club 28 is sequentially shown. The initial position is shown in FIG. 14A wherein shafts 28 and 30 are in alignment and club 28 is properly held at training grip 34. Hinge 32 will pivot during the backswing when the golfer's wrists are hinged, as is shown in FIG. 14B. At the end of the backswing club 28 is swung downwardly. Hinge 32 remains pivoted during most of the downward swing as does the golfer's wrist. Prior to the bottom of the downward swing, hinge 32 is still pivoted, wherein shaft 28 will be parallel to the ground, as is clearly shown in FIG. 14C. After which the golfers wrist are released (i.e., straighten out) and shafts 28 and 30 snap back into alignment, as is clearly shown in FIG. 14D. Shafts 28 and 30 may remain in alignment during the follow through swing. If club 26 is used to hit a golf ball, it will be appreciated that cover 42 will not be employed.

Club 28, when used as described above, teaches the golfer to maintain proper wrist position throughout the golf stroke. Should club 28 be swung improperly, hinge 32 will not pivot, as is shown in FIG. 13. Also, if during the downswing the golfer's wrist are released early, shafts 28 and 30 will snap back into alignment. Therefore, club 28 can aid in eliminating the following common golf swing errors: hitting behind the ball; hitting on top of the ball; swinging outside-inside, loss of power, casting (premature release during the downward high trajectery and hooking.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. A practice golf club comprising:

an upper shaft having a first predetermined length;

a lower shaft having a second predetermined length, said second predetermined length being shorter than said first predetermined length;

a grip secured about one end of said upper shaft;

a club head secured at one end of said lower shaft, said club head having a club face;

a first hinge member having first and second ends, said first end of said first hinge member being connected to one end of said lower shaft; and a second hinge member having first and second ends, said first end of said second hinge member being connected to one end of said upper shaft, said second end of said second hinge member being pivotably connected to said second end of said first hinge member to allow said lower shaft to pivot in a selected direction relative to said upper shaft, said selected direction being generally rearwardly and upwardly from a reference plane which corresponds to a plane in which said club face would lie with a 0° loft, and at a selected angle of approximately 45° relative to said reference plane.

2. The practice golf club of claim 1 wherein said angle is 45°.

3. The practice golf club of claim 1 wherein said grip comprises a molded training grip.

4. The practice golf club of claim 1 wherein said club head comprises an iron.

5. The practice golf club of claim 4 further comprising:

cover means disposed about said club head.

6. The practice golf club of claim 1 wherein said club head comprises a wood.

7. The practice golf club of claim 1 wherein said first hinge member comprises:

a collar;

a symmetrical portion depending downwardly from said collar and connected to one end of said lower shaft; and a tongue portion extending upwardly from said collar, said tongue portion having a first aperture extending laterally therethrough, one end of said tongue having a conformably sloping shoulder;

wherein said second hinge member comprises:

a body portion having a groove which defines a pair of fingers at one thereof, said tongue portion of said first hinge member being disposed between said fingers of said groove, one end of said groove having a rounded sloping shoulder being engaged by said conforming sloping shoulder of said tongue portion, said fingers having a second aperture therethrough, said first aperture through said tongue being in substantial alignment with said second aperture through said fingers; and a cylindrical portion extending upwardly from said body portion and connected to one end of said upper shaft; and a pin extending through said first and second apertures to provide said pivotal connection.

* * * * *